United States Patent [19]

Hansen

[11] Patent Number: 4,525,961

[45] Date of Patent: Jul. 2, 1985

[54] DOUBLE-GLAZED WINDOW FOR INSERTION IN OPENINGS IN WALLS OR DOORS OF A SANDWICH-TYPE CONSTRUCTION

[75] Inventor: Helge Hansen, Greve Strand, Denmark

[73] Assignee: Thermoform A/S, Greve Strand, Denmark

[21] Appl. No.: 604,102

[22] Filed: Apr. 26, 1984

[51] Int. Cl.[3] ..... E06B 3/00

[52] U.S. Cl. ..... 52/208; 52/213

[58] Field of Search ..... 52/204, 213, 217, 788, 52/455, 208

[56] References Cited

U.S. PATENT DOCUMENTS

| | | | |
|---|---|---|---|
| 2,710,994 | 6/1955 | Mills | 52/208 |
| 2,902,727 | 9/1959 | Samolis | 52/217 |
| 3,042,160 | 7/1962 | Price | 52/217 X |
| 3,969,857 | 7/1976 | Stark | 52/217 X |
| 4,128,977 | 6/1978 | Shubeis | 52/217 X |
| 4,387,542 | 6/1983 | Wehr | 52/455 X |

*Primary Examiner*—Carl D. Friedman
*Assistant Examiner*—Creighton Smith
*Attorney, Agent, or Firm*—Lawrence Rosen

[57] ABSTRACT

A double-glazed window for insertion in openings in walls or doors of a sandwich-type construction. The glazing comprises two identical transparent elements with an integral pane portion and an edge portion having sealing ribs. Internal covering means comprising two rib sections that overlap each other to provide an inner seal. The height of the rib sections are less than the thickness of the sandwich material, and the rib sections may also interengage each other.

5 Claims, 2 Drawing Figures

DOUBLE-GLAZED WINDOW FOR INSERTION IN OPENINGS IN WALLS OR DOORS OF A SANDWICH-TYPE CONSTRUCTION

The present invention relates to a window for insertion in openings in walls and doors of sandwich construction. The sandwich construction comprises a porous core between panels of a hard, high tensile material, for example, a metal such as steel plate. More specifically, the invention relates to double-glazed windows.

Normally windows comprise a front frame and a rear frame of aluminum inserted in the wall opening from the outside and the inside, respectively, and interconnected by, for example, screws. The outside frame incorporates a groove for holding the window pane. It has been proposed to insert a flanged rubber sealing rim with lips overlapping the inner and outer edges of the sandwich constructions and the edge of a glazing element. The glazing element may be a hermetic, double-glazed element of acrylic plate material. These windows are inconvenient to mount, require exact fitting in the opening and are expensive to manufacture. Furthermore, the framing must be adapted to the thickness of the sandwich construction.

An object of the invention is to provide a window which is simple to install, has adjustability to the exact dimensions of the opening, and is inexpensive to mass produce.

A further object of the invention is to provide a window that may be used with sandwich materials having different thicknesses.

The double-glazing in accordance with the invention is characterized in that it comprises two identical glazing elements covering the opening on opposite sides of the sandwich construction and overlapping the panels outside the opening. Each glazing element comprises a central integral pane portion having a smooth surface and an edge portion having sealing ribs in engagement with the panels. Means are provided for covering the porous core at a distance from the wall edge. The covering means comprises two overlapping upstanding rib sections. Each rib section traverses approximately over half the distance from the inner surface of its corresponding edge portion. The rib sections overlap and may interengage each other, thus providing a seal across the thickness of the sandwich construction.

Figure 1:
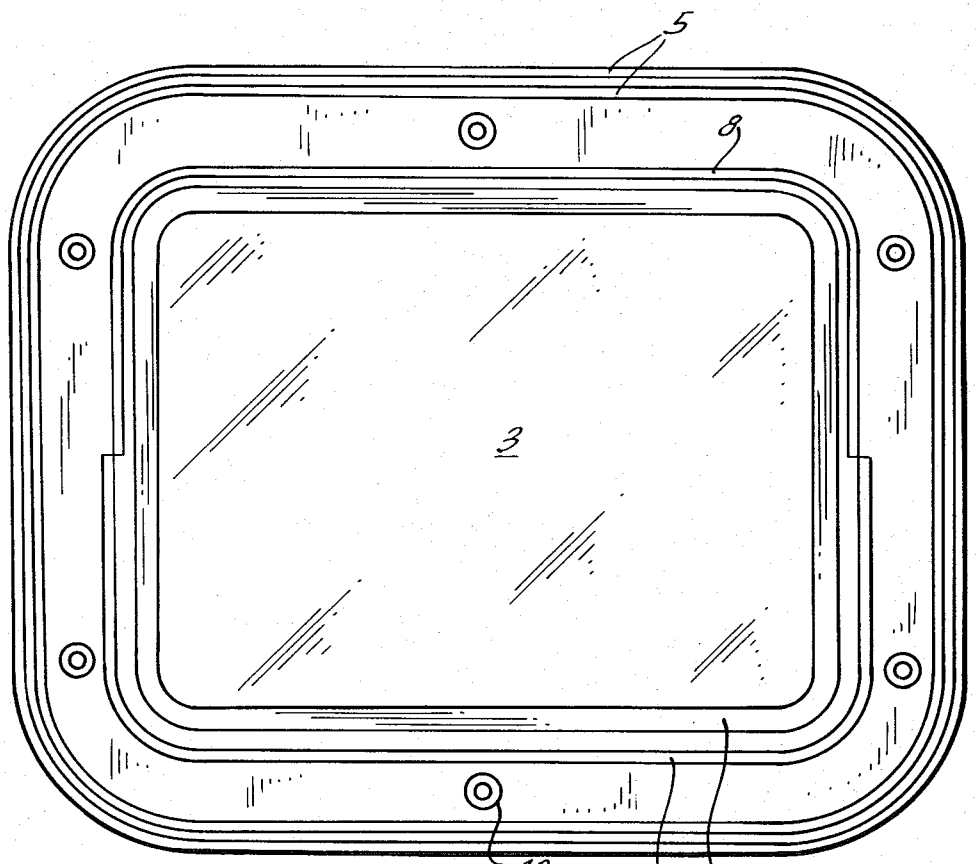
Figure 2:
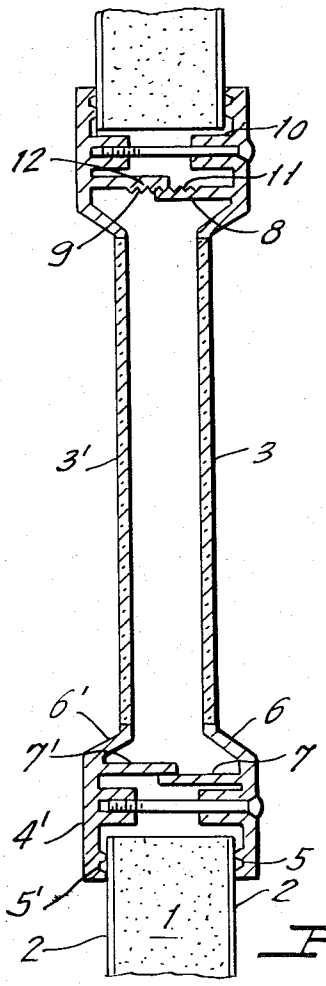

Further details and advantages of the double-glazed window of this invention will become apparent from the following detailed description with reference to the drawings in which:

FIG. 1 is a sectional view through a wall with the double-glazed window inserted in an opening thereof, and FIG. 2 is a plan view of a glazing element viewed from the inside of a double-glazed window.

An opening has been made in a wall or door of sandwich material having a core 1 of a light, porous insulating material covered by panels 2 of steel plating. Preferably, the opening is rectangular with rounded corners in order to reduce weakening of the sandwich material. The opening is closed by means of a double-glazed window comprising two identical glazing elements 3,3' mounted on opposite sides of the door or wall with edge portions 4,4' overlapping the panels 2. The edge portions 4,4' are provided with ribs 5,5' for holding a strip of sealant in recess 13. The edge portions 4,4' are provided with a rough surface making these portions non-transparent in contrast to the central portion 3,3'. Preferably the central portion 3,3' is recessed with respect to the edge portion 4,4' in order to increase stiffness of the glazing element 3,3'. Furthermore, this recessed portion 6,6' provided the glazing element with a pleasing appearance not unlike an ordinary window fastened by means of a rubber gromet or seal.

In order to reduce the visibility of the core material when viewed obliquely through the central portion of the window covering means 7,7' are provided. The covering means comprises two interengaging upstanding rib sections, as best seen in FIG. 1. Each rib section 7,7' traverses approximately over half the distance from the inner surface of the edge protions 6,6'. The rib sections overlap and may interengage each other, thus providing a seal across the thickness of the sandwich construction. The rib sections are adjacent the recessed portions 6,6' The height of each rib is less than the thickness of the sandwich core 1 in which the glazing is to be mounted, but more than half of this thickness. This arrangement makes it possible to use two identical glazing elements inverted with respect to each other to complete a covering as shown in the sectional view of FIG. 1, thereby reducing the costs of producing forms for casting of the glazing elements.

The elements 3,3' may be provided with studs 10 for insertion of a screw or similar fastener by means of which the glazing elements may be pressed against the panels 2 in order to compress the sealing material in groove 13. The heads of the screws are preferably placed on the inside of the door or wall.

The rib sections can have inside toothing 11 as shown in rib section 8 and an outside toothing 12 as shown in section 9 to provide additional fastening means. The toothing will interlock, when the glazing elements are pressed together from opposite sides of the door or wall. With such an arrangement, the double-glazed window will be non-removable, and must be completely renewed after breakage. If, however, the glazing elements are molded from a polycarbonate plastic, the window will resist rough handling and breakage during normal use. Correspondingly, the window will provide a high security against unauthorized access to the building in which the wall or door is placed.

If the rib sections are arranged into a larger number of subsections this will improve the guiding of the glazing elements toward each other. Thereby, it is unlikely that the toothings may disengage owing to a displacement of the glazing elements with respect to each other.

We claim:

1. A double-glazed window for insertion in openings in walls and doors of sandwich construction having a porous core between panels of harder material, said window comprises two identical glazing elements covering the opening on opposite sides of the sandwich construction and overlapping the panels outside the opening, each glazing element comprising a central integral pane portion with a smooth surface and an edge portion with sealing ribs in engagement with the panels, covering means are disposed within said glazing elements for covering the porous core at a distance from the edge of the core, said covering means comprising two overlapping rib sections that project upright from an inner surface of a corresponding edge portion, each protruding rib being of a height of at least half the thickness of the sandwich construction.

2. The double-glazed window according to claim 1, wherein fastening means are arranged in the edge portion outside the covering means.

3. The double-glazed window according to claim 1, wherein the central portion is recessed.

4. The double-glazed window according to claim 1, wherein the surface of each of the edge portions is rough.

5. The double-glazed window according to claim 1, wherein the covering means comprise interlocking means.

* * * * *